United States Patent [19]

Hintzen et al.

[11] 3,930,453

[45] Jan. 6, 1976

[54] MEANS FOR PRODUCING PIPING OPENINGS IN BLANKS OF GARMENTS

[75] Inventors: Peter Hintzen, Krickenbach; Erich Willenbacher, Karlsruhe, both of Germany

[73] Assignee: Pfaff Industriemaschinen GmbH, Kaiserslautern (Pfalz), Germany

[22] Filed: May 22, 1974

[21] Appl. No.: 472,220

[30] Foreign Application Priority Data

May 29, 1973 Germany ..... 2327255

[52] U.S. Cl. ..... 112/68

[51] Int. Cl.[2] ..... D05B 3/10

[58] Field of Search ..... 112/68, 65, 66, 70, 76

[56] References Cited

UNITED STATES PATENTS

| | | | |
|---|---|---|---|
| 2,529,072 | 11/1950 | Bradford et al. | 112/68 |
| 2,573,359 | 10/1951 | Rich | 112/65 |
| 2,889,790 | 6/1959 | Smith et al. | 112/68 X |

*Primary Examiner*—H. Hampton Hunter
*Attorney, Agent, or Firm*—Robert H. Jacob

[57] ABSTRACT

Arrangement for producing piped openings in cut blanks of garments, comprising a displaceable supporting plate and a folding device including a folding slide for piping strips defined by movable folding tools and a working blank clamp displaceable relative to the needles of a double needle sewing machine having a separating cutter working centrally between the needles and adapted to be lowered upon the cut blank, two folding and clamping rails defining a folding shaft between them supported for vertical movement and pivotally supported at their upper ends for rocking movement toward and away from one another and relative to said folding slide, means for raising and lowering said folding and clamping rails together by an adjustable distance relative to a cut blank in said folding shaft.

11 Claims, 10 Drawing Figures

MEANS FOR PRODUCING PIPING OPENINGS IN BLANKS OF GARMENTS

Figure 1:
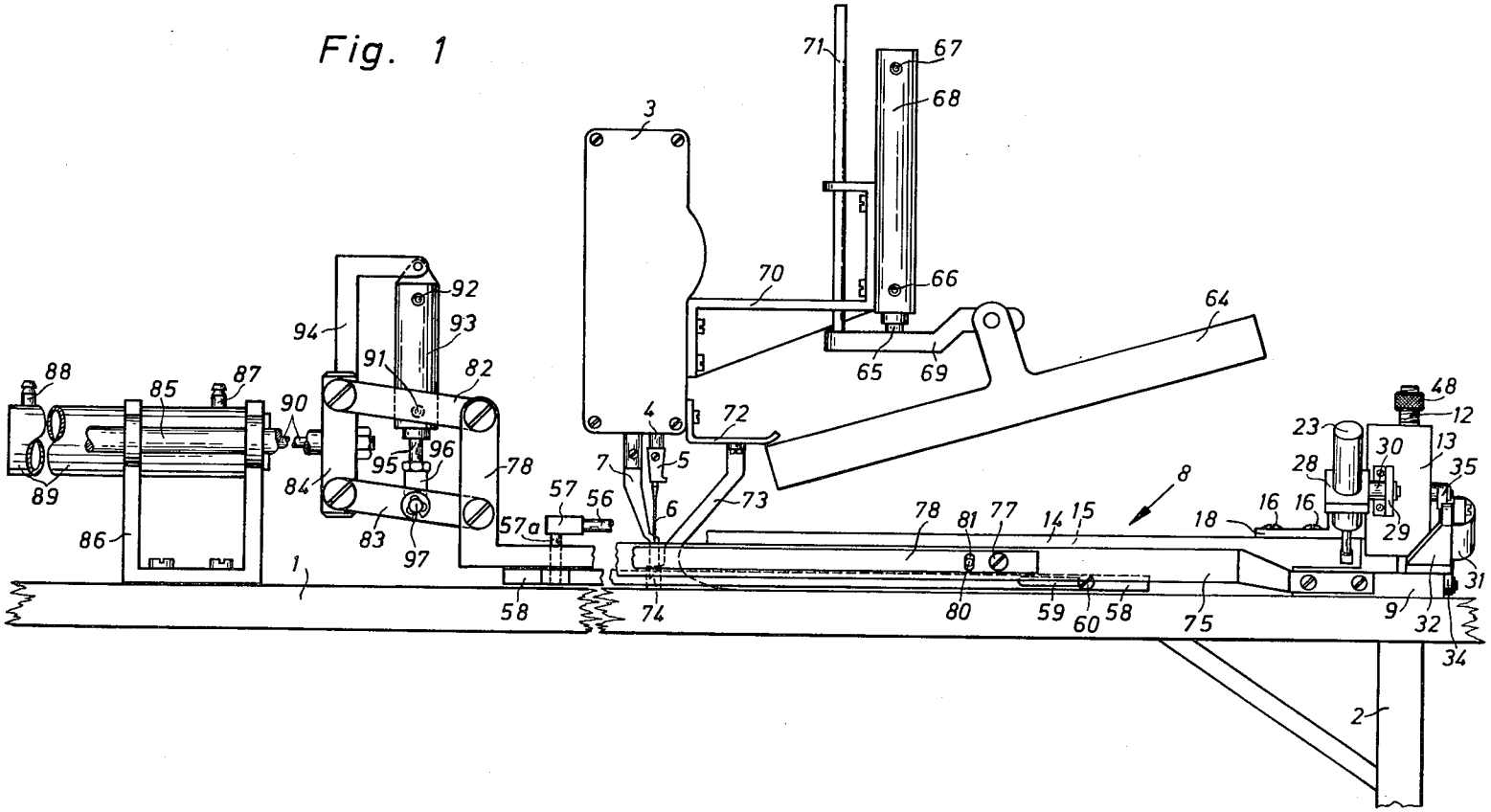

The invention relates to an arrangement for producing piping openings in blanks for garments comprising a displaceable supporting plate and a folding means consisting of movable folding tools for the piping strip as well as a displaceable cutting knife operating centrally between the needles relative to a double needle machine and a work blank clamp that can be lowered upon the work blank.

Devices for producing piping openings are already known that have a movable metal retaining sheet with a clamping plate for the piping strip called a clamping last that are movable in a plane that is inclined relative to the vertical direction. The retaining plate which is provided with abutments for aligning the piping strip moves the piping strip to the upper side of the working blank and there is disposed below one part of a folding clamp consisting of two partial members of ⊥ -shaped cross section. The two partial members of the folding clamp are arranged one behind the other in the direction of feed approximately at the distance of the length of a work blank in order to obtain an overlapping manner of operation.

The piping strip resting on the top side of the clamp is folded into a folding shaft of the work blank substantially in U-shape through one partial member of the folding clamp and is pressed against the blank part resting on the work blank. The upwardly extending legs of the piping strip folded in U-shape are pressed by means of forming strips movable relative to one another that are arranged on the work blank clamp against the upwardly extending bridge of the ⊥ -shaped part member of the folding clamp. The piping strip thereby has imparted to it the ⊥ -shape required for the blank being sewed on.

When being shifted to the stitch forming locations of the sewing machine the piping strip so folded must be pushed from the one stationary partial member of the folding clamp to the other stationary partial member which is also ⊥ -shaped. In order to make it possible at all to carry along the piping strip with the blank portion both partial members of the folding clamp may not rest firmly on the blank part, respectively the piping strip must not be pressed too strongly against the blank part. As a result the carrying along of the piping strip as the blank part is displaced by means of the work blank clamp merely as a result of the friction between the contacting surfaces of the folded piping strips and the blank portion on the one hand and the front edges of the forming blanks and the piping strip on the other hand. In this connection the friction between the piping strip and the stationary partial pieces of ⊥ -shaped cross section of the folding clamps must be overcome.

An undesirable displacement of the position of the piping strip with respect to the main material cannot be avoided under these circumstances especially where the stretch between the folding station disposed at a distance of a work blank length from the needles for the piping strip and the needles is to be bridged during rapid operation and accordingly the starting jolt of the undesirable displacement effect is additionally amplified.

It is an object of the invention to provide an arrangement of the above type where the folding tools for the piping strip are smooth and constructed at the same time as clamping and displacement tools for piping strips and garment cuts.

In accordance with the invention, this problem is solved by two folding and clamping rails, cooperating with a folding slide that is vertically movable, which for pulling tight the piping strip that is slid in between the folding and clamping rails in a folding shaft can be raised together by an adjustable distance and adapted to be lowered onto the cut blank for outwardly directed bulging of the tightened parts of the piping strip so that they may be lowered upon the material cut on both sides of the folding slide.

The folding and clamping rails are disposed on supports so that they may be readily exchanged which supports are slidably guided on standing bolts secured to the working blank clamp. For producing the movement in opposite direction, the folding and clamping rails are connected with one another with pivotable bearings provided with a toothed segment that is journalled on the supports.

The movement of the folding and clamping rails which is composed of upward movement and downward movement the magnitudes of which differ from one another, and which are to take place in a continuous working stroke of pneumatic or some other servo arrangement is in accordance with a further proposal of the invention produced by means of a knee joint arranged for movement out of a buckled position through the stretched position into another buckled positon between the working piece clamp and the supports of the folding and clamping rails.

If the downward movement of the folding and clamping rails is to be reduced without changing in this connection, the uninterrupted thrust of the drive means that extends in one direction, then it is desirable to construct the guide of the knee joint telescopically and equip it with an intermediate spring member.

In order to limit and adjust the upward thrust of the folding and clamping rails, one suitably uses an adjustable abutment.

For the passage of the needle, the folding and clamping rails each have a slot extending in the direction of forward movement.

The folding shaft into which the folding slide folds the piping strip consists advantageously of support sheet metal elements movable against one another along the work element clamp, the drive of which is by way of standing bolts which are fastened on a displaceable frame on the working blank clamp and extend in guiding slots in the supporting elements directed obliquely to the displacement direction of the frame.

In order to be able to prepare a further piping strip for the next work blank already during the course of the sewing operation, the supporting plate provided with the abutments for the piping strip is pivotable out of an initial position that is inclined relative to the horizontal about a horizontal axis and can be entered between the folding and clamping rails and the supporting blades arranged upon the working blank clamp. The supporting plate is furthermore provided with a recess permitting a relative movement between itself and the folding slide in two planes that are perpendicular to one another. It can furthermore be returned into its initial position while the folding slide is in its lowered position upon the work blank portion.

The existing angular adjustment of the supporting plate, which in the initial setting must be in an oblique position for securing the contact of the piping strip on the one limiting abutment and for introducing the piping strip in the folding station parallel to the top side of the work blank clamp, is determined in a simple manner by abutments which are provided in the range of movement of the parts of the supporting plate that are at a distance from the bearing axis.

For supporting the forming of the piping strip the folding slide has a compressed air channel, which on both sides of the folding edge leads into laterally directed compressed air outlet nozzles through which compressed air emerges during the forming operation of the piping strip.

An embodiment of the arrangement in accordance with the invention is illustrated in the accompanying drawings, which is explained more in detail hereinafter.

Shown are in

Figure 2:
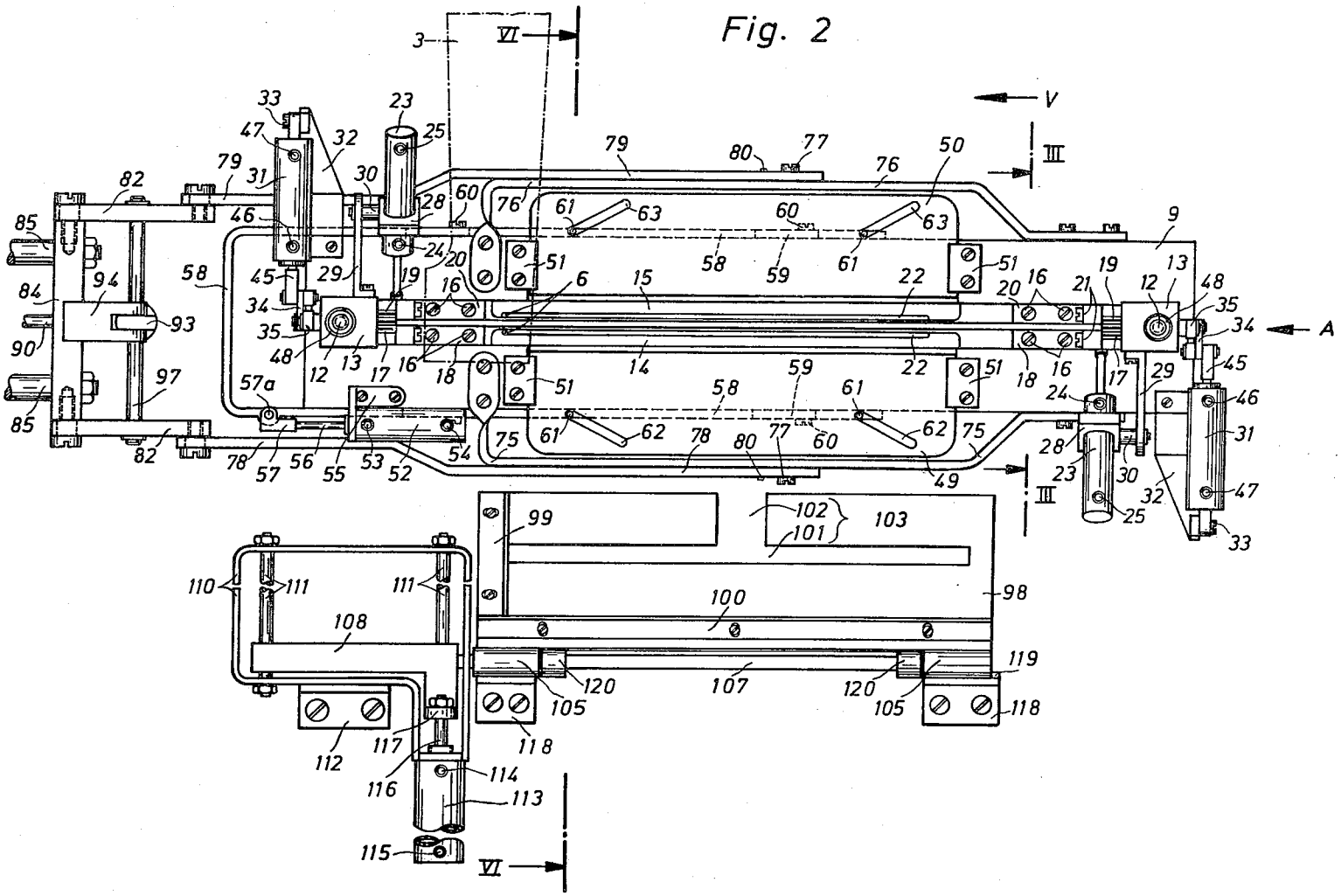
Figure 3:
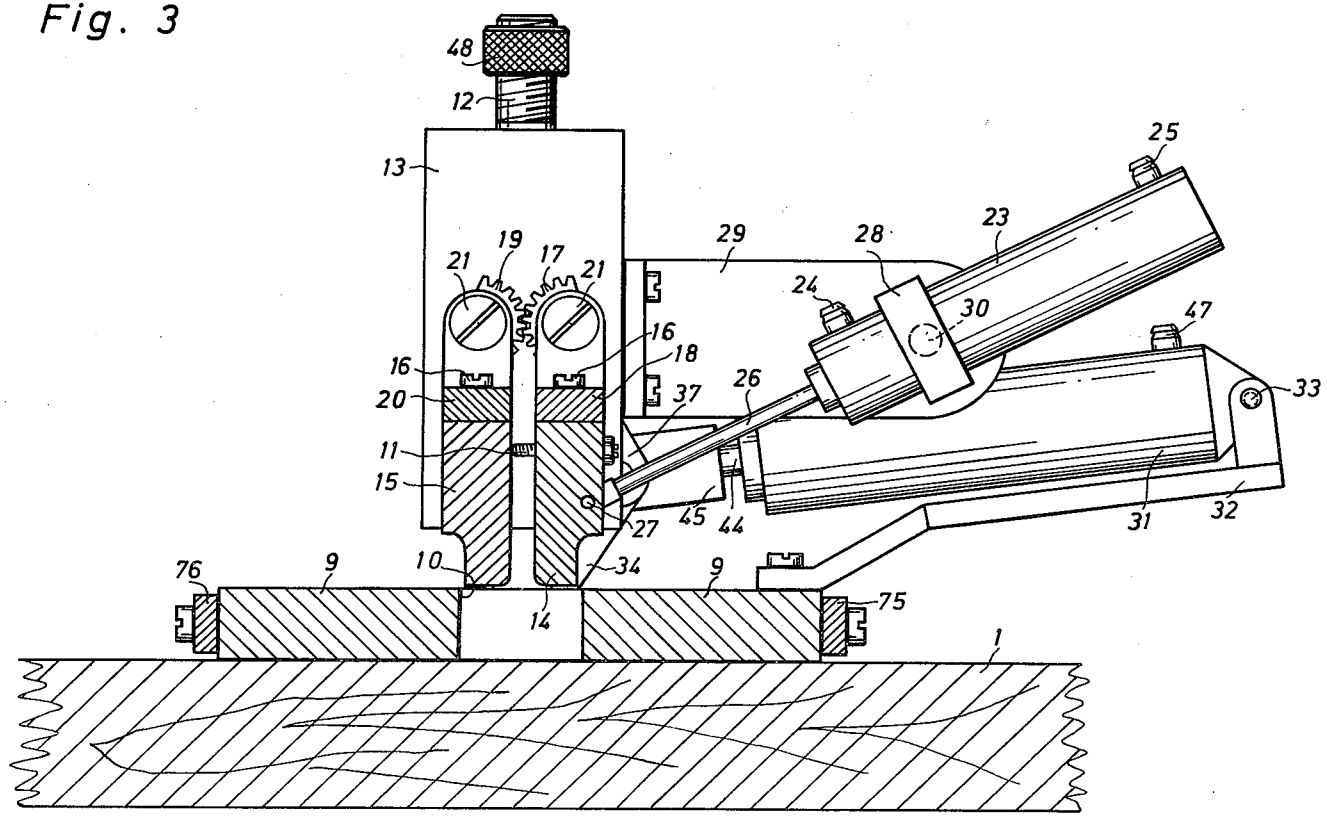
Figure 4:
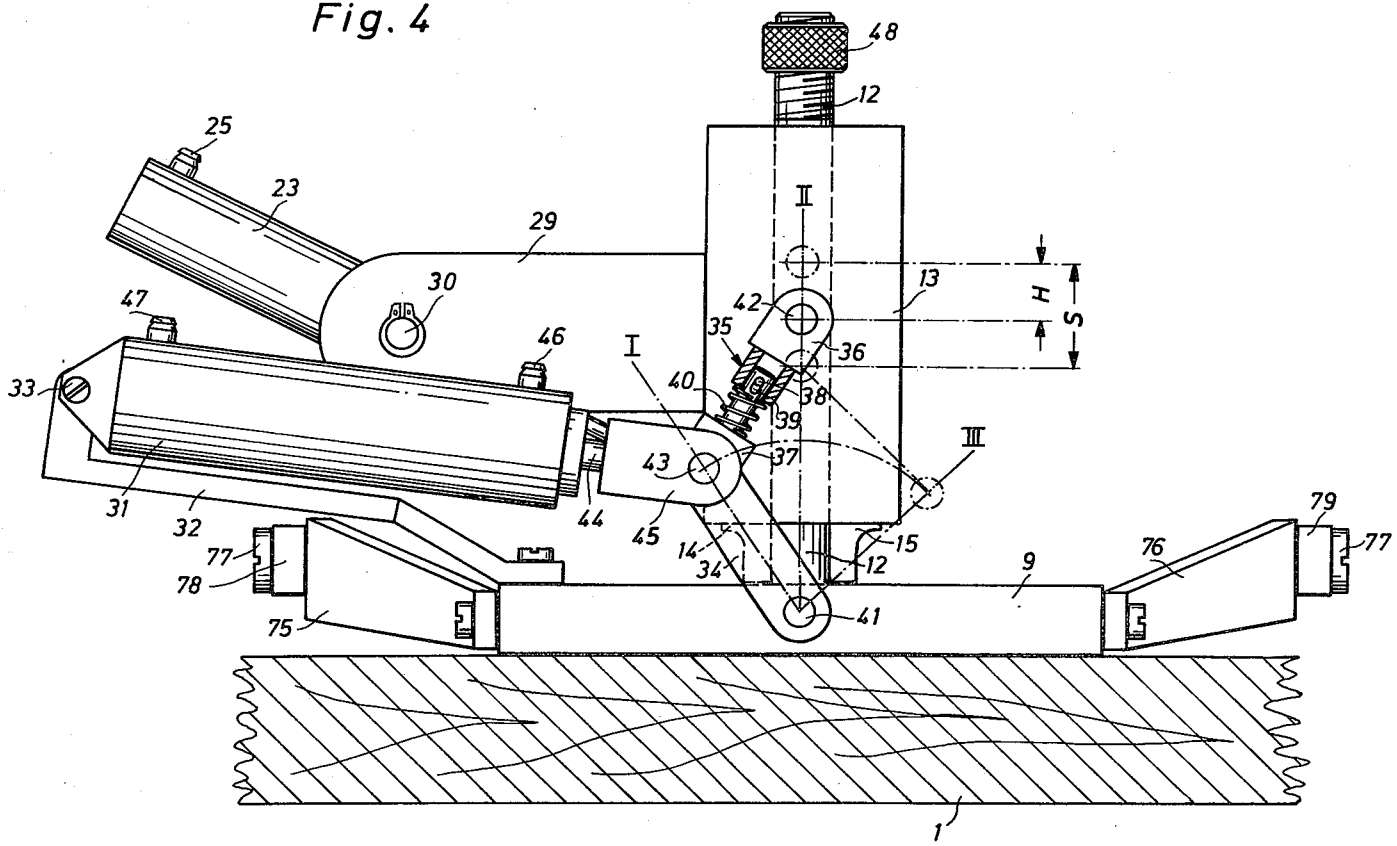
Figure 5:
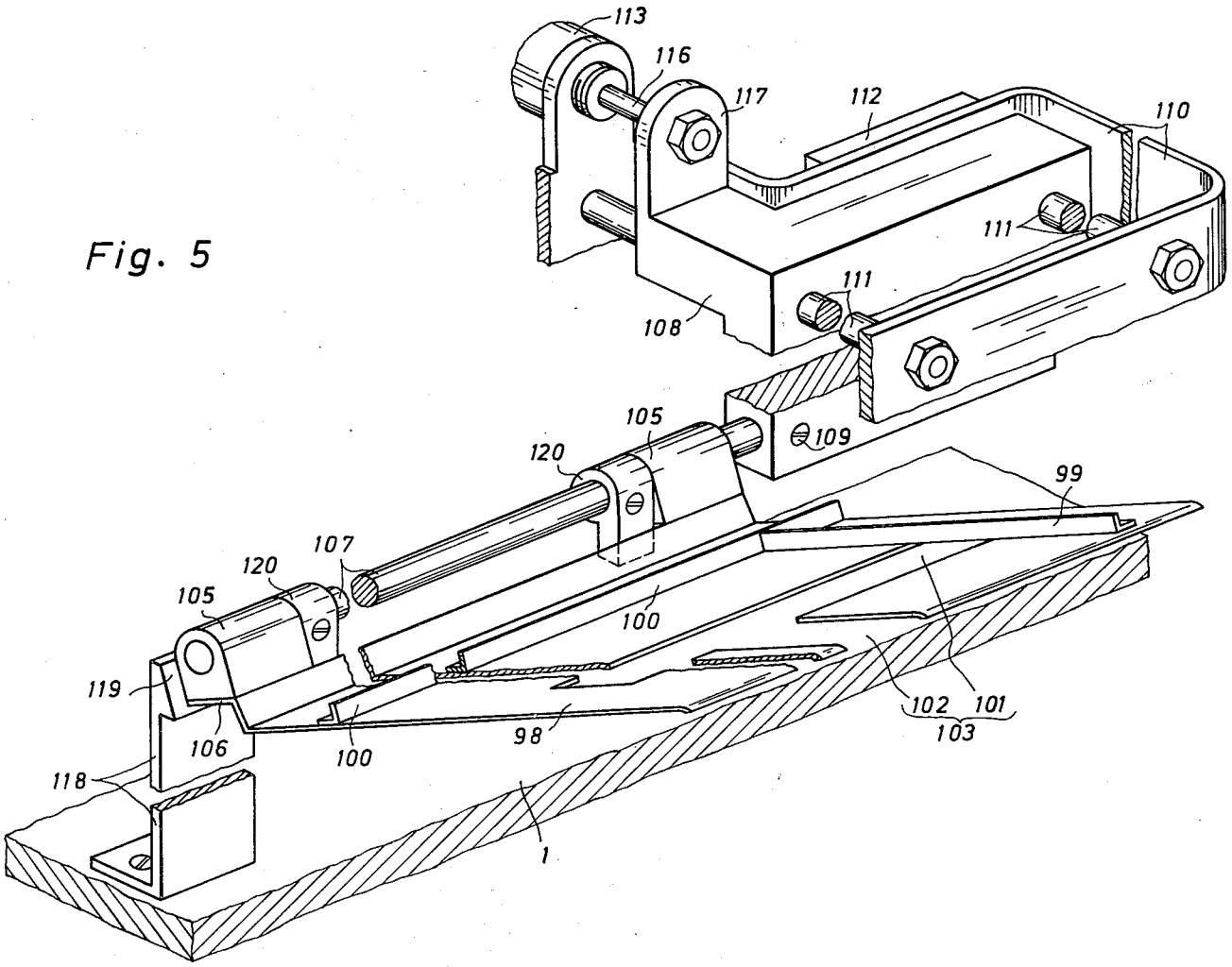
Figure 6:
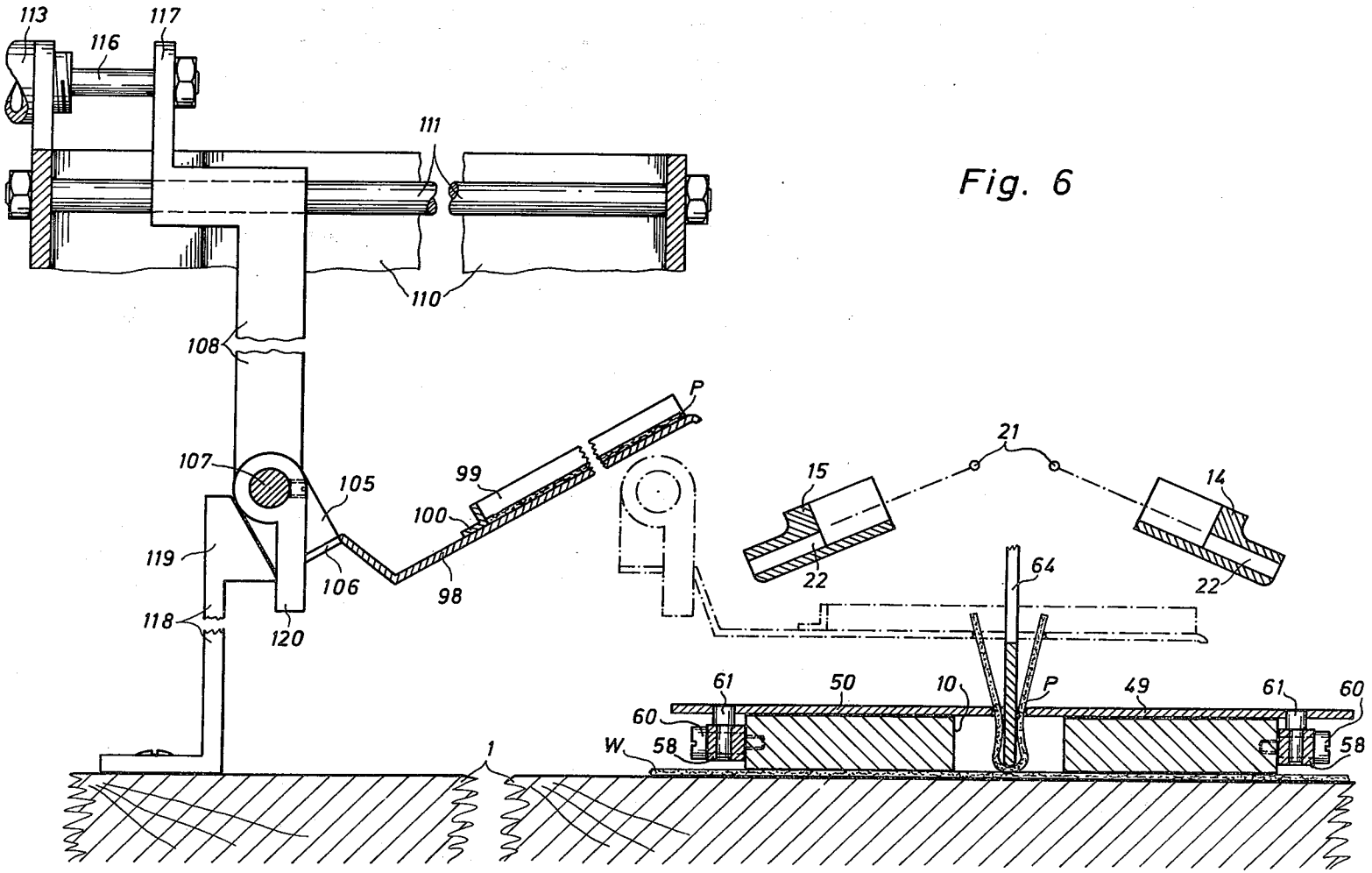
Figure 8:
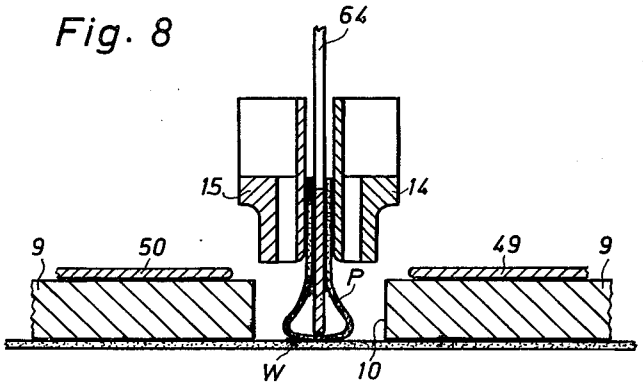
Figure 10:
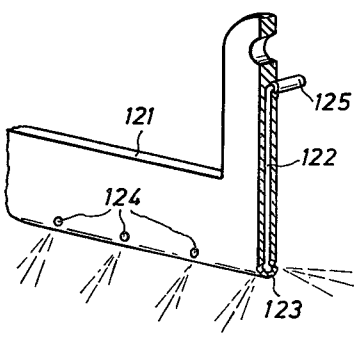
Figure 7:
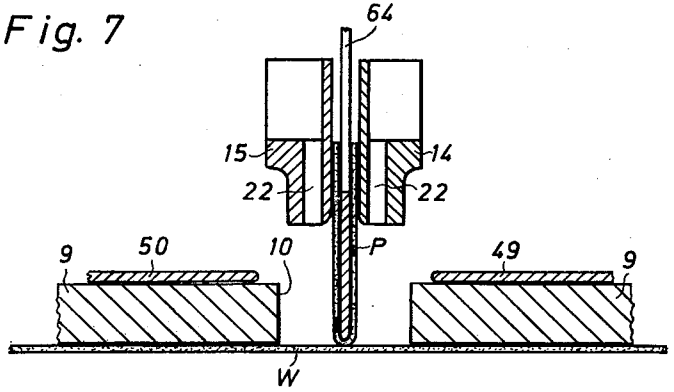
Figure 9:
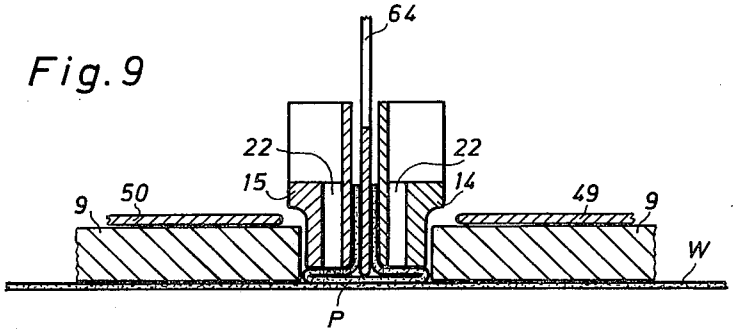

FIG. 1, to a reduced scale a side view of the arrangement with a sewing machine having only a partly illustrated working blank clamp and a folding slide in the starting position, FIG. 2, a plan view of the working blank clamp illustrated in FIG. 1 and the supporting plate for the piping strip with its driving means, FIG. 3, a section along line III—III of FIG. 2 in normal size, FIG. 4, a view taken in the direction of arrow A in FIG. 2, FIG. 5, a perspective illustration of the supporting plate for the piping strip and its guide means, FIG. 6, a section along line VI—VI of FIG. 2, the supporting plate in its starting position and the setting of the folding slide, the folding and clamping rails and the supporting members after the insertion of the piping strip into the folding shaft defined by the supporting elements, FIGS. 7, 8 and 9, illustrate the manner of operation of the folding tools during forming of the piping strip by the illustration of the parts in three different phases during the forming operation, and FIG. 10 shows a folding slide provided with compressed air exit nozzle.

The entire apparatus is arranged upon the table plate 1 of a frame 2.

A known two-needle sewing machine 3 serves as the unit for forming two independent seams with needles 6 arranged in needle holder 5 secured centrally on the needle bar 4 for forming two independent seams with a separating knife 7 for cutting open the engagement slot of the piping opening. The sewing machine 3 is also equipped with an arrangement for cutting off the threads and is driven by an electromotor that is not shown. It is adapted to be stopped in a selectable position by means of a needle positioning device. The initiation and ending of the sewing operation and the control of the other working operations is effected by a known programmed control using pneumatic electromagnetic valves.

The work blank clamp 8 has a base plate 9 in which there is a recess 10 that extends in the pushing direction V into which the piping strip P is folded.

In the base plate 9 of the work blank clamp 8 a standing bolt 12 is fastened to each end. On each standing bolt 12 a support 13 for a pair of folding and clamping rails 14, 15 is slidably guided. The distance between the two rails 14, 15 in their working or clamping position is adjustable by means of a spacing screw 11 in the folding and clamping rail 14.

The clamping rail 14 is screwed at both ends by means of screws 16 onto a pivot bearing 18 provided with a toothed segment 17, and the clamping rail 15 is likewise screwed at both ends by means of screws 16 to one each pivot bearing 20 provided with a toothed segment 19. The pivot bearings 18 and 20 are each pivotable about a collar screw 21 on the supports 13. The toothed segments 17 and 19 of the pivot bearings 18 and 20 are in meshing engagement, so that the clamping rails 14, 15 are connected with one another for movement in opposite directions by means of the pivot bearings 18, 20 that are provided with the toothed segments 17, 19.

The folding and clamping rails 14, 15 each have a longitudinal slot 22 for the passage of the needles 6. To provide a free space into which the needle holder 5 enters during sewing they are recessed as shown in FIGS. 7 to 10, and besides they are offset into the recess 10 in the base plate 9 at the outer sides. The oppositely disposed surfaces of the folding and clamping rails 14 and 15 may be provided with a rubber-like coating in order to obtain better gripping.

For pivoting and folding clamping rails 14, 15 two double acting pressure air cylinders 23 are provided, one of each of which is arranged on the clamping rails 14, 15 at the outer sides, and this on each opposed end of the two folding and clamping rails 14, 15. Since the two air pressure cylinders 23 and the parts serving for their arrangement and securing are equal to one another, they are provided with uniform reference numerals.

Each compressed air cylinder 23 has two connections 24 and 25 each of which is connected with a compressed air duct. The piston bar 26 of one compressed air cylinder 23 is linked by means of a pin 27 to the folding and clamping rail 14, and that of the other compressed air cylinder 23 by means of a pin 27 to the folding and clamping rail 15. Each compressed air cylinder 23 is received in a retainer 28 which is rotatably supported about a shaft 30 that is fastened to an angular member 29 on a support 13.

For displacement of the folding and clamping rails 14, 15 arranged on the supports 13 upon the standing bolts 12, two double acting compressed air cylinders 31 are provided, one of which is arranged laterally alongside of one support 13 on the one side of the folding and clamping rail 14 and the other laterally alongside the other support 13 on the side of the folding and clamping rail 15, each on an angular member 32 secured to the base plate 9 pivotable about a collar screw 33.

At the outer end of each support 13 a knee joint (FIG. 4) is arranged consisting of two links 34 and 35. One link 34 is rigid and the other 35 is telescopically shaped. The link 35 consists of a partial member 36 having a longitudinal bore and a partial member 37 provided with a stud. The stud of this partial member 37 is slidably received in the longitudinal bore of the partial member 36.

To limit the sliding path a pin 38 is secured in the partial member 36 which extends through a longitudinal slot 39 in the stud of the partial member 37. Between the two partial members 36 and 37 a pressure spring is interposed that is arranged upon the stud of the partial member 37, which tends to separate the two partial members 36 and 37.

The rigid link 34 is pivotable at one end about a stud 41 on the end of base plate 9, and the partial member 36 of the link 35 pivots about a stud 42 on the support 13. In the pivot point of the two links 34 and 35 the connecting member 45 is joined that is fastened by means of a stud 43 on the piston bar 44 of the compressed air cylinders 31. The compressed air cylinders 31 each have connections 46 and 47, each of which is connected to a compressed air supply.

For limiting the upward movement of the folding and clamping rails 14, 15 that are provided on the supports 13, two abutments 48 in the form of knurled nuts are arranged on the folding and clamping rails 14, 15, which are screwed onto the outer threads of the bolts 12 that are threaded at their free ends.

The piping strip P is to be supported on both sides as it is slid into the recess 10 of the base plate 9 where it assumes a generally U-shaped form. For this purpose two supporting members 49, 50 that are slidable relative to one another are provided in a recess of the base plate 9, which are covered at both ends by guide plates 51 screwed onto the plate 9.

The displacement of the supporting members 49, 50 transversely of the forward movement of the work blank clamp 8 is effected by a double acting compressed air cylinder 52 which has connections 53 and 54 and which furthermore has an angular member 55 arranged upon the base plate 9, and whose piston bar 56 is connected by way of an intermediate element 57 and a pin 57a with a frame 58 displaceably disposed on the outer sides of the base plate 9. The frame 58 is provided with several longitudinal slots 59 for guidance, through which collar screws 60 are extended that are screwed into the base plate 9. In the frame 58 there are four standing bolts 61 which extend upwardly into guiding slots 62, 63 in the supporting plates 49, 50 obliquely to the direction of feed V. The guiding slots 62, 63 extend obliquely in opposite directions in order to make it possible to move the supporting members 49, 50 toward or away from one another as the frame 58 is moved.

In order to slide the piping strip P into the recess 10 of the base plate 9 or into the folding shaft defined by the supporting members 49, 50 of generally U-shape, a folding slide 64 is provided above the folding and clamping rails 14, 15 which is journalled for pivotal movement on a support 69 secured to a compressed air cylinder 68 that has two connections 66, 67 and is double acting. The connections 66 and 67 of the compressed air cylinder 68 are each connected to a compressed air conduit.

The compressed air cylinder 68 is secured to a supporting angular member 70 that is fastened to the housing of the machine. For straight guidance of the folding slide 64 a guiding bar 71 is fastened to the support 69 and slidably guided in bores of the supporting angle 70.

In the range of movement of one end of the folding slide 64 an abutment angle 72 secured to the machine housing is arranged which is contacted by the left end of the folding slide 64 during upward movement, whereupon the folding slide 64 is pivotally moved during the further course of the upward movement of the piston bar 65 about its pivot connection on the support 69 into an oblique position (FIG. 1).

On the abutment angle 72 is a separating plate 73 for the borders of the piping strip 11 that extend upwardly after folding between the folding and clamping rails 14, 15, which is disposed directly in front of the separating cutter 7. The separating plate 73 has a guiding groove 74 for the separating cutter 7 at its end facing the separating cutter 7.

In order to provide the driving gear for the work blank clamp 8 two frames 75, 76 made of flat iron are provided on the base plate 9, each of which is drilled at one end by 90° and is screwed with the drilled end onto the top side of the base plate 9 and at the other end to the reduced and small outside of the base plate 9 that is offset relative to the base plate 9.

The work blank clamp 8 is pivotably arranged by means of two head screws 77 on two latches 78, 79 screwed into the straps 75, 76. The longitudinal axes of the head screws 77 coincide with an axis extending through the center of gravity of the work blank clamp 8 of the head screws 77. The pivotal movement of the work blank clamp 8 is limited by a pin 80 secured at a lateral distance from the head screws 77 in the latches 78, 79 which extends into a longitudinal slot 81 in the straps 75, 76.

The latches 78, 79 extend at an angle upwardly and are pivotally connected by two parallel pairs of links 82, 83 with a support plate 84 that is fastened to two guiding bars 85 which are guided in a bearing block 86 for sliding movement in the advancing direction V.

For displacement on the working blank clamp 8 in advancing direction V arranged in a parllelogrammic manner on the supporting plate 84 a hydro-pneumatic advancing unit 89 known per se, having two connections 87, 88 is arranged, the piston bar 90 of which is connected to the support plate 84.

The raising and lowering of the work blank clamp 8 is effected by a compressed air cylinder 93 provided with two connections 91, 92 which is received at one end on an angular member 94 welded to the support plate 84 and whose piston bar 95 supports a piston 96 which is disposed with its transversely bored end on a bar 97 connecting the lower pair of links 83.

The piping strip P is in this arrangement brought under the folding slides 64 constituting the folding shaft defined by the flat supporting 49, 50 to be described hereinafter. For this purpose serves the supporting plate 98, FIGS. 2, 5 on which there are two rectangularly disposed abutment strips 99, 100 for the piping strip P which are adjustable and disposed at a right angle.

In the supporting plate 98 there is a longitudinal slot 101 directed parallel to the direction of feed V for the passage of the folding slide 64 through which the folding slide 64 pushes the piping strip P in U-shaped folded form into the recess 10 in the base plate 9 or into the folding shaft defined by the supporting members 49, 50 under the folding clamping rails 14, 15. A transverse slot 102 follows the longitudinal slot 101 which is somewhat wider than the securing bridge of the folding slot 64. The longitudinal slot 101 and the transverse slot 102 define a recess 103 which permits displacement of the supporting plate 98 in a horizontal direction toward one side onto a cut-out part W as the folding slide 64 is in lowered position. The supporting plate 98 is provided with two offset projections 106 for mounting bearing members 105 by means of which the bearing members 105 are fixedly connected, for example by hard soldering.

The supporting plate 98 is pivotally journalled on one horizontal bearing axis 107 by means of bearing member 105 fastened by means of screws 109 in a sliding guide 108. The sliding guide 108 is slidably guided on two parallel bars 111 secured in a frame 110. The frame 110 is soldered to an angular member 112, FIGS. 2, 5 fastened to the table plate 1. The sliding guide 108 and, therefore, the supporting plate 98 is slidable by means of a double acting compressed air cylinder 113 on the guiding bars 111. The compressed air cylinder 113 has connections 114, 115. The piston bar 116 of the compressed air cylinder 113 is connected to a strip 117 of the sliding guide 108.

For determining the starting position of the supporting plate 98 in which the piping strip P is to be placed with two edges disposed at right angles to one another against the abutment strips 99, 100 during the current sewing operation on the supporting plate 98 and in which the supporting plate 98 is to assume an oblique position (FIGS. 5, 6) to simplify the joining and insure the joining of the piping strip P at the abutment strips 99, 100 two angular members 118 are screwed onto the table plate 1. The upper ends of these angular members are in the form of approach cams 119 with an oblique surface that determines the oblique position of the supporting plate 98, against which the bearing members 105 place themselves in the starting position of the support plate 98.

The horizontal position illustrated in dot and dash lines in FIG. 6 of the supporting plate 98 is determined by two abutments 120 that are secured to the bearing axis 107.

In FIG. 10 a folding slide 121 is illustrated which can be disposed on the support 69 instead of the folding slide 64. The folding slide 121 has a compressed air channel 122 on the inside, which on both sides leads into obliquely downwardly directed compressed air exit nozzles 124. On the securing bridge of the folding slide 121 a connection 125 for a compressed air conduit is provided.

Starting with the arrangement that the parts of the installation are in the standstill condition of the sewing machine with the needle in the upward position, furthermore that a pipe strip P had been placed upon the obliquely disposed supporting plate 98 with two abutment slabs 99, 100 in engagement at right angles with their side edges with one another, that the working blank clamp 8 is lowered by supply of compressed air by way of connection 92 from the compressed air cylinder 93 of a cut-out part W disposed on the table plate, and finally that the folding and clamping rails 14, 15 are in the open position illustrated in FIG. 6. Starting with this condition, the arrangement operates as follows:

By supplying compressed air by way of connection 115, FIG. 2, of the compressed air cylinder 113, the sliding guide 108 with the bearing axis 107 secured thereto and the supporting plate 98 mounted thereon is displaced on the guiding bars 111 relative to the working blank chamber 8. At the start of the displacement movement the supporting plate 98 pivots about the bearing axis 107 into its horizontal position under the effect of the inherent gravity which position is determined by the abutments 120 disposed in its pivoting area. During the further course of the displacement movement the supporting plate 98 is moved between the folding and clamping rails 14, 15 disposed in the open position, FIG. 6, and the supporting members 49, 50 on the base plate 9 into the end position illustrated in dot and dash lines in FIG. 6 in which the longitudinal slot 101 of the supporting plate 98 is located by way of the recess 10 of the base plate 9.

At the same time as the compressed air cylinder 113 is actuated, also the compressed air cylinder 52 is supplied with compressed air by way of connection 53. Thus, the frame 58 is displaced in a direction opposite to the feed direction V, FIG. 2.

During this displacement movement the supporting members 49, 50 are displaced as a result of the cooperation of the standing bowl 61 in the frame 58 with the oblique slots 62, 63 in the support members 49, 50 into a position in accordance with FIG. 6 where for sliding in the piping strip P into the recess 10 a slot serving as folding slot for passage remains free.

The piping strip P placed upon the supporting plate 98 is thereupon moved downwardly through the folding slide 64 by supply of compressed air by way of connection 67 to compressed air cylinder 68, through the longitudinal slot 101 in the supporting plate 98 and the slot between the two supporting plates 49, 50 into the recess 10 of the base plate 9 of the work blank clamp 8 is pressed on as shown in FIG. 6 folded in U-shape against the cut member W.

The supporting plate 98 is then moved back onto the cut member W into its initial position by supply of compressed air by way of connection 114 of the compressed air cylinder 113 for the sliding guide 108. This is possible in that the supporting plate 98 is provided with the transverse slot 102 in the area of the fastening bridge of the folding slide 64 that begins at the longitudinal slot 101.

Shortly before reaching the initial position the bearing members 105 of the supporting plate 98 encounter the engagement knuckles 119. Accordingly, the supporting plate 98 is swung in the final phase of the return movement about the bearing axis 107 into its oblique position illustrated in FIGS. 5 and 6. Beginning already at this point where the supporting latch 98 has reached its starting position, a new piping strip P can be placed onto the supporting plate 98.

By supplying compressed air by way of connections 25 of the compressed air cylinder, FIGS. 3, 4, the folding and clamping rails 14, 15 are pivotally moved about their collar screws 21 that serve as their bearing axes due to their mutual connection by means of toothed segments 17, 19 into their clamping position, FIGS. 3 and 7–10. In this position they press the raised free legs of the U-shaped piping strip P that is slid in a plier-like manner into the recess 10 of the folding slide 64. The clamping position of the folding and clamping rails 14, 15 can be adapted by adjusting the spacing screw 11, FIG. 3, to the different material thicknesses of the piping strip P.

The supporting members 49, 50 can now be returned to their initial position. For this purpose compressed air is supplied by the compressed air cylinder 51 by way of connection 54 whose piston bar 56 displaces the frame 58 in the feeding direction V, FIG. 5, by way of the intermediate member 57 and the pin 57a on the frame 58. As a result the supporting members 49, 50 are displaced into their starting position in accordance with FIGS. 2 and 7-9 by the cooperation of the standing bolts 61 with the oblique slots 62, 63 transversely to the feeding direction V.

For tightening the raised borders that is folded into U-shape on both sides of the folding slide 64 and for the following folding down of the tightened nut part clamp of the piping strip P in such a manner that the piping strip P has imparted to it the ⊥ in accordance with FIG. 9 required by the cut portion compressed air is supplied to both compressed air cylinders 31 by way of their connection 47.

In a continuous working operation the two knee joints 34, 35 that engage the connecting members 45 are by way of the piston rods 44 and the two knee joints 34, 35 pressed out of their initial position the buckle position I through the stretched position II into a further buckling position III. Thereby the supports 13 that are displaceable upon the bolts 12 and thus the folding and clamping rails 14, 15 are first raised by the stretch indicated at "H" in FIG. 4.

Due to the friction between the raised borders of the piping strip P and the clamping surfaces of the folding and clamping rails 14, 15 which touch the raised borders, the raised borders of the piping strip P are tightened.

The magnitude of the upward movement of the folding and clamping rails 14, 15 which depends on the width of the parts of the piping strip P that are visible on the finished garment can be limited by adjusting the setting screws 48 on the standing bolt 12. It is variable within the limits determined by the length of the longitudinal slot 13 in the part member 37 of the links 35. In this connection the telescopically constructed links 35 make possible the through-movement of the knee joints 34/35 through the stretch position II.

During the downward movement that follows the upward movement of the folding and clamping rails 14, 15 by the stretch "S," FIG. 4, when guiding the knee joints 34/35 from the stretched position II into the collapsed position III, the non-clamped parts of the piping strip P are bent outwardly away from the folding slide 64. They are then pressed against the cut portion W in double layers as shown in FIG. 9. In this position the folding and clamping rails 14, 15 remain until the end of the sewing operation. An inintentional relative displacement between the cut portion W and the piping strip P does not have to be effected.

For supporting the bending operation of the tightened non-clamped part of the piping strip P, the folding slide 64 can be exchanged against the folding slide 121 illustrated in FIG. 10 by way of its connection 125 while during the downward movement of the folding and clamping rails 14, 15 compressed air is discharged through the nozzles 124.

The folding slide 64 or 121 is moved back at the end of the forming operation of the piping strip P into its initial position in accordance with FIG. 1. This is effected by the supply of compressed air by way of connection 66 of the compressed air cylinder 68.

The movements of the working blank clamp 8 for sewing on the piping strip P with two independent seams and for cutting open the entrance slot extending centrally between the two seams are subsequently so controlled by the hydraulic pneumatic feeding unit 89, FIG. 1, as the sewing machine operates preferably at the rhythm of the stitch formation by suitable supply of pressure material by way of connection 87, that first the beginning of the two seams, for example by condensation of stitches is latched, then the seams are formed by suitable connecting and disconnecting of the separating cutter 7, and the conventional insert slot is cut open and at the end of the seam, the seams are likewise latched by condensation of the stitches.

The raised edges of the piping strip P are thereby kept separated by the separating blade 73 so that the separating cutter 7 arrives safely between the two raised borders of the piping strip P.

Upon reaching the ends of the seam, the threads are cut off at the last upward movement of the needle bar and the sewing machine is stopped as the needle is in raised position. The supply of pressure means by the feeding unit 89 is interrupted. By supply of compressed air by way of connection 91 of the compressed air cylinder 93, FIG. 1, the working blank clamp 8 is lifted off from the cut portion W by means of the piston bar 95 that engages the connecting bar 97 of the parallel pair of linkers 83 and can be moved to a stacking location by a moving device. Meanwhile the seamstress places the next cut portion W onto the table plate 1, and in this connection aligns it in accordance with certain optical markings.

By supplying compressed air by way of connections 46 of the compressed air cylinders 31 and connections 24 of the compressed air cylinders 23, the folding and clamping rails 14, 15, are then guided back out of their clamping and operating position illustrated in FIG. 9 into the starting position in accordance with FIG. 6. The working blank clamp 8 is then moved back by supplying pressure means by way of the connection 88 of the feed unit 89 into its starting position in accordance with FIGS. 1 and 2 over the newly placed cut portion W. Since a new piping strip P could already be placed after the insertion of the piping strip P into the recess 10 and the returning of the supporting plate 98 into its starting position in accordance with FIGS. 2, 5 and 6, the course described can begin anew.

Having now described our invention with reference to the embodiment illustrated in the drawings, what we desire to protect by letters patent of the United States is set forth in the appended claims.

We claim:

1. Arrangement for producing piped openings in cut blanks of garments, comprising a displaceable supporting plate and a folding device including a folding slide for piping strips defined by movable folding tools and a working blank clamp displaceable relative to the needles of a double needle sewing machine having a separating cutter working centrally between the needles and adapted to be lowered upon the cut blank, two folding and clamping rails defining a folding shaft between them supported for vertical movement and pivotally supported at their upper ends for rocking movement toward and away from one another and relative to said folding slide for clamping a piping strip disposed around said folding slide, means for raising and lowering said folding and clamping rails together by an adjustable distance relative to a cut blank in said folding shaft whereby the parts of the piping strip pressed against the folding slide during upward movement of the folding and clamping rails are pulled tight and outwardly directed bulges of the tightened parts of the piping strip below said rails are formed on both sides of said slide during the downward movement of said rails.

2. Arrangement in accordance with claim 1, comprising standing bolts secured in the working blank clamp on supports displaceably supporting folding and clamping rails.

3. Arrangement in accordance with claim 2, where the folding and clamping rails are connected with one another by way of pivot bearings provided with a tooth segment journalled above the supports.

4. Arrangement in accordance with claim 3, where for producing the vertical movements of the folding and clamping rails a knee joint is provided that is movable out of its collapsed position through a stretched position into a further collapsed position between the working blank clamp and the supports of the folding and clamping rails, and where one line of the knee joint is telescopically formed and equipped with an intermediate spring member.

5. Arrangement in accordance with claim 4, comprising an adjustable abutment for limiting the upwardly directed displacement movement of the folding and clamping rails by a standing bolt.

6. Arrangement in accordance with claim 5 comprising a passage slot for a needle in the folding and clamping rails.

7. Arrangement in accordance with claim 6, comprising supporting members on the work blank clamp that are displaceable relative to one another for defining the folding shaft, which are driven by way of standing bolts fastened in a frame displaceably mounted on the work blank clamp, said bolts extending through slotted guides in the supporting plates directed obliquely to the displacement direction of the frame.

8. Arrangement in accordance with claim 1, comprising a supporting plate for the piping strip that is provided with abutments movable out of a horizontally inclinded initial position about a horizontal axis and between the folding and clamping rails and the supporting plates disposed between the work blank clamp and has a recess permitting a relative movement between itself and the folding slide in two planes perpendicular to one another and can be returned to the starting position while the folding slide is in its lower position on the cut blank.

9. Arrangement in accordance with claim 1, including abutments in the range of movement of the parts of the supporting plate disposed at a distance from the bearing axis for determining the angular settings of the supporting plate relative to the horizontal.

10. Arrangement in accordance with claim 1, where the folding slide is provided with a compressed air channel which leads on both sides of the folding edge to laterally directed compressed air outlet nozzles.

11. Arrangement in accordance with claim 1 including bolts secured to the working blank clamp for guiding the folding and clamping rails, said rails being pivotally mounted for movement about the bolt and means permitting displacement of the bolts and means for pivotally moving the folding and clamping rails in opposite directions.

* * * * *